US010564568B2

(12) United States Patent
Jung et al.

(10) Patent No.: US 10,564,568 B2
(45) Date of Patent: Feb. 18, 2020

(54) ELECTROPHOTOGRAPHIC IMAGE FORMING APPARATUS AND METHOD FOR DETECTING RELEASE OF DEVELOPMENT NIP

(71) Applicant: HP Printing Korea Co., LTD., Suwon-si (KR)

(72) Inventors: Won-chul Jung, Suwon (KR); Joon-hee Kim, Suwon (KR); Young-hwan Kim, Suwon (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 16/239,896

(22) Filed: Jan. 4, 2019

(65) Prior Publication Data

US 2019/0137904 A1 May 9, 2019

Related U.S. Application Data

(63) Continuation of application No. PCT/KR2016/013832, filed on Nov. 29, 2016.

(30) Foreign Application Priority Data

Jul. 15, 2016 (KR) ..... 10-2016-0090265

(51) Int. Cl.
*G03G 15/08* (2006.01)
*G03G 15/06* (2006.01)
(Continued)

(52) U.S. Cl.
CPC ..... *G03G 15/0848* (2013.01); *G03G 15/065* (2013.01); *G03G 15/167* (2013.01);
(Continued)

(58) Field of Classification Search
CPC ..... G03G 15/0848; G03G 21/1825; G03G 21/1828; G03G 21/1832
See application file for complete search history.

(56) References Cited

U.S. PATENT DOCUMENTS

2004/0052540 A1 3/2004 Kyung
2005/0069342 A1* 3/2005 Kanno ..... G03G 21/1825 399/111
(Continued)

FOREIGN PATENT DOCUMENTS

KR 10-2014-0095403 8/2014
KR 10-2016-0074232 6/2016

*Primary Examiner* — Sandra Brase
(74) *Attorney, Agent, or Firm* — Staas & Halsey LLP

(57) ABSTRACT

Provided is a method of detecting release of a development nip of an image forming apparatus that includes a photoconductor and a developing roller to contact each other to form a development nip and to be away from each other to release the development nip. The method includes obtaining a reference load, after charging the photoconductor in a state in which the development nip is formed, by measuring a load of a transfer system including the photoconductor and a transfer roller, release the development nip and blocking light irradiated from an exposing unit to the photoconductor, obtaining a detected load by measuring a load of the transfer system after exposing the photoconductor, and determining whether the development nip is normally released based on the reference load and the detected load.

20 Claims, 11 Drawing Sheets

(51) Int. Cl.
*G03G 15/16* (2006.01)
*G03G 15/00* (2006.01)
*G03G 21/18* (2006.01)

(52) U.S. Cl.
CPC ..... *G03G 15/5041* (2013.01); *G03G 21/1825* (2013.01); *G03G 21/1832* (2013.01)

(56) References Cited

U.S. PATENT DOCUMENTS

| | | | | |
|---|---|---|---|---|
| 2008/0138107 | A1* | 6/2008 | Mori | G03G 15/0813 399/111 |
| 2011/0255884 | A1* | 10/2011 | Matsuda | G03G 15/55 399/26 |
| 2013/0243457 | A1 | 9/2013 | Kaneko et al. | |
| 2015/0355573 | A1 | 12/2015 | Jeong et al. | |

* cited by examiner

ELECTROPHOTOGRAPHIC IMAGE FORMING APPARATUS AND METHOD FOR DETECTING RELEASE OF DEVELOPMENT NIP

CROSS-REFERENCE TO RELATED APPLICATIONS

This application is a continuation application of PCT international patent application no. PCT/KR2016/013832, filed on Nov. 29, 2016, which claims priority from Korean Patent Application No. 10-2016-0090265, filed on Jul. 15, 2016 in the Korean Intellectual Property Office, the content of each of the foregoing is incorporated herein by reference.

BACKGROUND

An electrophotographic image forming apparatus forms an image on a recording medium by using an electrophotographic method, and a method of detecting release of a development nip. An image forming apparatus using an electrophotographic method supplies toner on an electrostatic latent image formed in a photoconductor to form a visible toner image on the photoconductor, transfers the toner image onto a recording medium, and prints an image on the recording medium by fixing the transferred toner image on the recording medium.

BRIEF DESCRIPTION OF THE DRAWINGS

FIG. 2 shows a state in which a photoconductive drum and a developing roller contact each other and form a development nip, and FIG. 3 shows a state in which the photoconductive drum and the developing roller are placed apart from each other and the development nip is released;

FIG. 4 shows a state in which the development nip is formed, and FIG. 5 shows a state in which the development nip is released;

DETAILED DESCRIPTION

Figure 1:
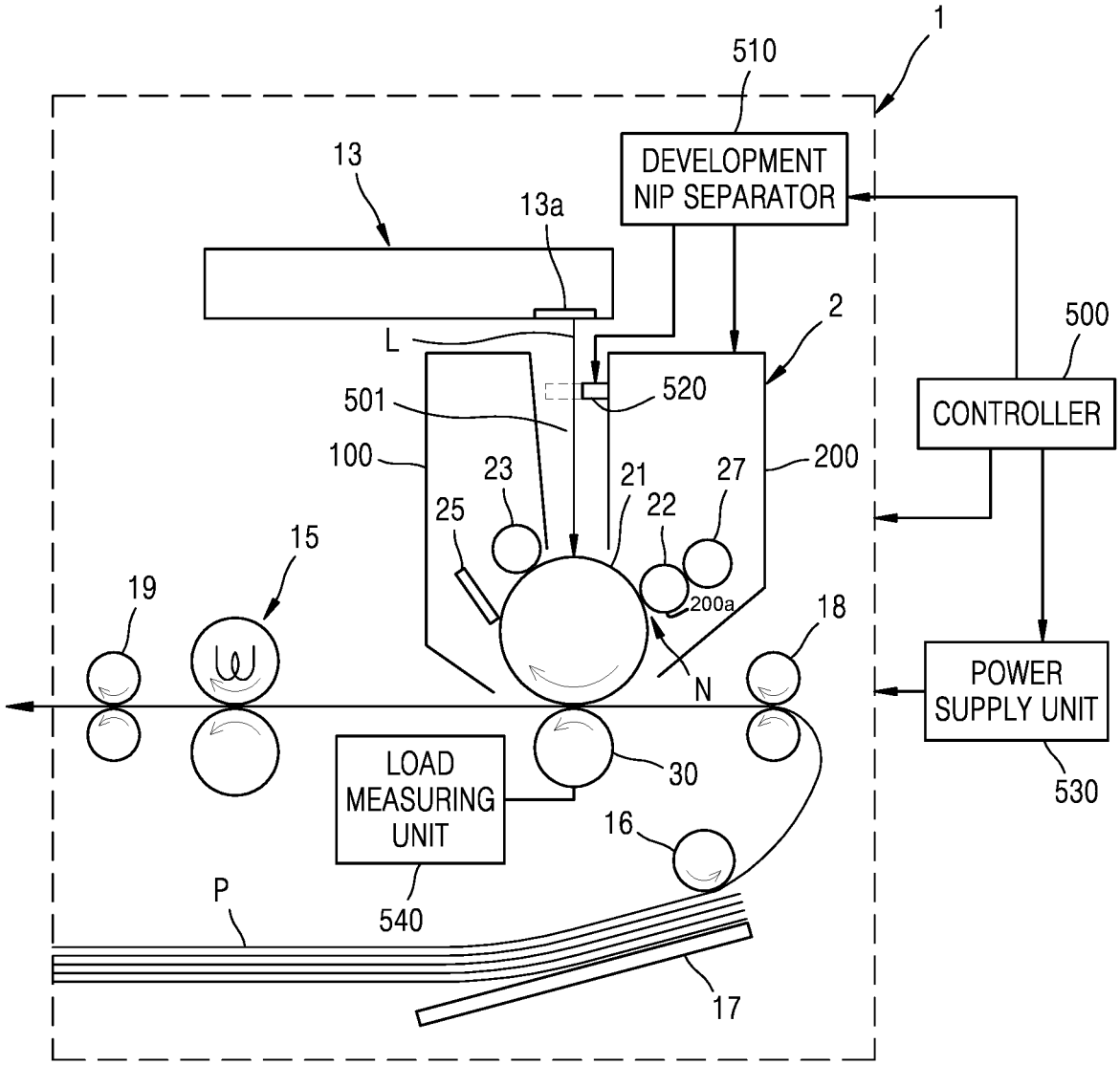
FIG. 1 is a diagram schematically showing an example of an electrophotographic image forming apparatus.

In an image forming apparatus using a contact development method, a developing roller and the photoconductor contact each other and form a development nip. When a long period of time passes in a state in which the development nip is formed, there are risks of deformation of the developing roller, damage to the photoconductor, and the like. Deformation of the developing roller and damage to the photoconductor may cause changes in the development nip, thereby causing an adverse effect on the quality of an image.

Accordingly, when an image forming operation is not being performed, the developing roller is placed apart from the photoconductor.

To detect whether the developing roller is separated from the photoconductor, a method of directly detecting the position of the developing roller by using a sensor, a method of detecting, by a sensor, the position of a component of a separation device that separates the developing roller from the photoconductor, and the like, may be considered; however, additional components like a sensor are needed.

According to an example of an image forming apparatus and a method of detecting release of the development nip, it is possible to detect, without using a sensor, whether the development nip is normally released. Accordingly, an increase in price of the image forming apparatus may be controlled. In addition, by detecting whether the development nip is normally released, degradation in image quality due to a development nip release error, and a decrease in lifespan of the development cartridge may be prevented. In addition, when the development cartridge is replaced with a new cartridge, it is possible to determine, through a process of releasing of the development nip, whether the development cartridge is defective or not.

Hereinafter, examples of an electrophotographic image apparatus and a method of detecting release of a development nip is described in detail with reference to attached drawings. Throughout the specification and the drawings, same reference numerals are used for components having same functions or configurations, and overlapping descriptions thereof are omitted.

FIG. 1 is a diagram schematically showing an example of an electrophotographic image forming apparatus. The image forming apparatus of the example, according to an electrophotographic method, prints a monochromatic image, for example, a black-color image, on a recording medium P. Referring to FIG. 1, the image forming apparatus may include a main body 1, and a plurality of development cartridges 2. The development cartridge 2 may accommodate a black-colored toner. Although it is not shown, the black-colored toner may be accommodated in a toner supplying container, and toner may be supplied from the toner supplying container to the development cartridge 2. The development cartridge 2 is attached to/detached from the main body 1. An exposure unit 13, a transfer unit, and a fixing unit 15 are provided in the main body 1. In addition, the recording medium transporting unit, which is used to load and transport the recording medium P on which an image is formed, is provided in the main body 1.

The development cartridge 2 in the example is an integral type development cartridge. The development cartridge 2 may include a photoconductive unit 100 and a developing unit 200.

The photoconductive unit 100 includes a photoconductive drum (a photoconductor) 21. The photoconductive drum 21, which is an example of a photoconductor to form an electrostatic latent image on a surface thereof, may include a conductive metal pipe and a photoconductive layer formed on an outer circumference of the conductive metal pipe. A charging roller (a charging member) 23 is an example of a charger that charges the photoconductive drum 21 to have a uniform surface potential. A charging brush, a Corona charger, and the like may be used instead of the charging roller 23. The photoconductive unit 100 may further include a cleaning roller (not shown) that removes a foreign material on a surface of the charging roller 23. A cleaning blade 25 is an example of a cleaning unit that removes toner and a foreign material that remain on a surface of the photoconductive drum 21 after a transfer process that is described later. Instead of the cleaning blade 25, another type of cleaning device, for example, a rotating brush, may be used.

The developing unit 200 supplies toner accommodated therein to the electrostatic latent image formed on the photoconductive drum 21 and develops the electrostatic latent image into a visible toner image. The method of development is classified into one-component developing method using toner and two-component developing method using toner and a carrier. The one-component developing method is used in the development cartridge 2 described in the example. The developing roller (a developing member) 22 is used to supply the toner to the photoconductive drum 21. A development bias voltage to supply the toner to the photoconductive drum 21 may be applied to the developing roller 22.

A contact developing method, in which the developing roller 22 and the photoconductive drum 21 contact each other and form the development nip, is adopted in the example. A supply roller 27 supplies toner in a toner receptor surface 200*a* of the developing roller 22. To do so, a supply bias voltage may be applied to the supply roller 27. The developing unit 200 may further include a regulator (not shown) that regulates an amount of toner that is supplied, by the developing roller 22, to the development nip N that is formed by contact of the photoconductive drum 21 and the developing roller 22. The regulator may, for example, be a doctor blade that elastically contacts a surface of the developing roller 22.

The exposure unit 13 irradiates light, which is modulated to correspond to image data, to the photoconductive drum 21, thereby forming an electrostatic latent image on the photoconductive drum 21. A laser scanning unit (LSU) using a laser diode as a light source, a light-emitting diode (LED) exposing unit using LED as a light source, and the like may be adopted as the exposure unit 13.

The transfer unit may include a transfer roller (a transfer member) 30. The transfer roller 30 faces the photoconductive drum 21 and forms a transfer nip through which the recording medium P is transported. A transfer bias voltage, which is used transfer the toner image formed in the photoconductive drum 21 onto the recording medium P, is applied to the transfer roller 30.

The power supply unit 530 supplies power to the main body 1. For example, the power supply unit 530, to the main body, provides a charging bias voltage, a supply bias voltage, a developing bias voltage, and a transfer bias voltage.

A controller 500 controls operations of the image forming apparatus. The controller 500 controls overall operations of the image forming apparatus by performing various computing processes, and may include a processor like central processing unit (CPU) and the like. The controller 500 may control the image forming apparatus to perform an operation corresponding to a user input when the image forming apparatus receives the user input via an input/output unit (not shown). In other words, the controller 500 may transmit signal, data, and the like to components of the image forming apparatus, or may perform computing processes on signal, data, and the like received from the components. Various kinds of data such as programs and files may be stored in a memory (not shown). The controller 500 may access data previously stored in the memory and using the stored data, or may store new data in the memory. An operation system (OS) being a basis of machine readable instructions-based configuration of the image forming apparatus and programs such as applications supporting various functions are stored in a memory, and the controller 500 may access the memory and perform operations by using data such as the programs stored in the memory.

When a print command is received from a host that is not shown and the like, the controller 500, by using the charging roller 23, charges the surface of the photoconductive drum 21 to have a uniform potential. The controller 500 controls the exposure unit 13 to irradiate the light L, which is modulated to correspond to the image data, to the photoconductive drum 21 and form the electrostatic latent image thereon. The developing roller 22 supplies toner to the photoconductive drum 21, and thus, the electrostatic latent image is developed to be a visible toner image. The recording medium loaded on a loading stand 17 is taken out sheet by sheet by a pickup roller 16 and is, by a feed roller 18, transported to the transfer nip that is formed by the transfer roller 30 and the photoconductive drum 21. The toner image is transferred onto the recording medium P due to the transfer bias voltage that is applied to the transfer roller 30. When the recording medium P passes through the fixing unit 15, the toner image is, due to heat and pressure, fixed on the recording medium P. The recording medium P, on which the toner images are fixed, is taken out by the discharge roller 19.

During an image forming operation, the photoconductive drum 21 and the developing roller 22 contact each other and form the development nip N. When the photoconductive drum 21 and the developing roller 22 are maintained in a state of contacting each other while the image forming operation is not performed, there are risks of deformation of the developing roller 22, damages to the photoconductor 21, and the like. In addition, while continually printing a plurality of images, when the photoconductive drum 21 and the developing roller 22 are kept in contact with each other during non-image forming sections between image forming sections, the toner on the developing roller 22 is passed to the photoconductive drum 21 during image forming sections, and thus, toner consumption increases, and waste toner may also increase; and as the photoconductive drum 21 and the developing roller 22 are rotated in contact with each other, life of the developing roller 22 may be shortened due to stress.

To overcome these shortcomings, there is provided the development nip separator 510 that forms the development nip N by contacting the developing roller to the photoconductive drum 21 in a printing mode (a time period of an image forming process and the image forming section) and releases the development nip N by separating the developing roller 22 from the photoconductive drum 21 in a non-printing mode (when the image forming process is not performed and the non-image forming section).

Figure 2:
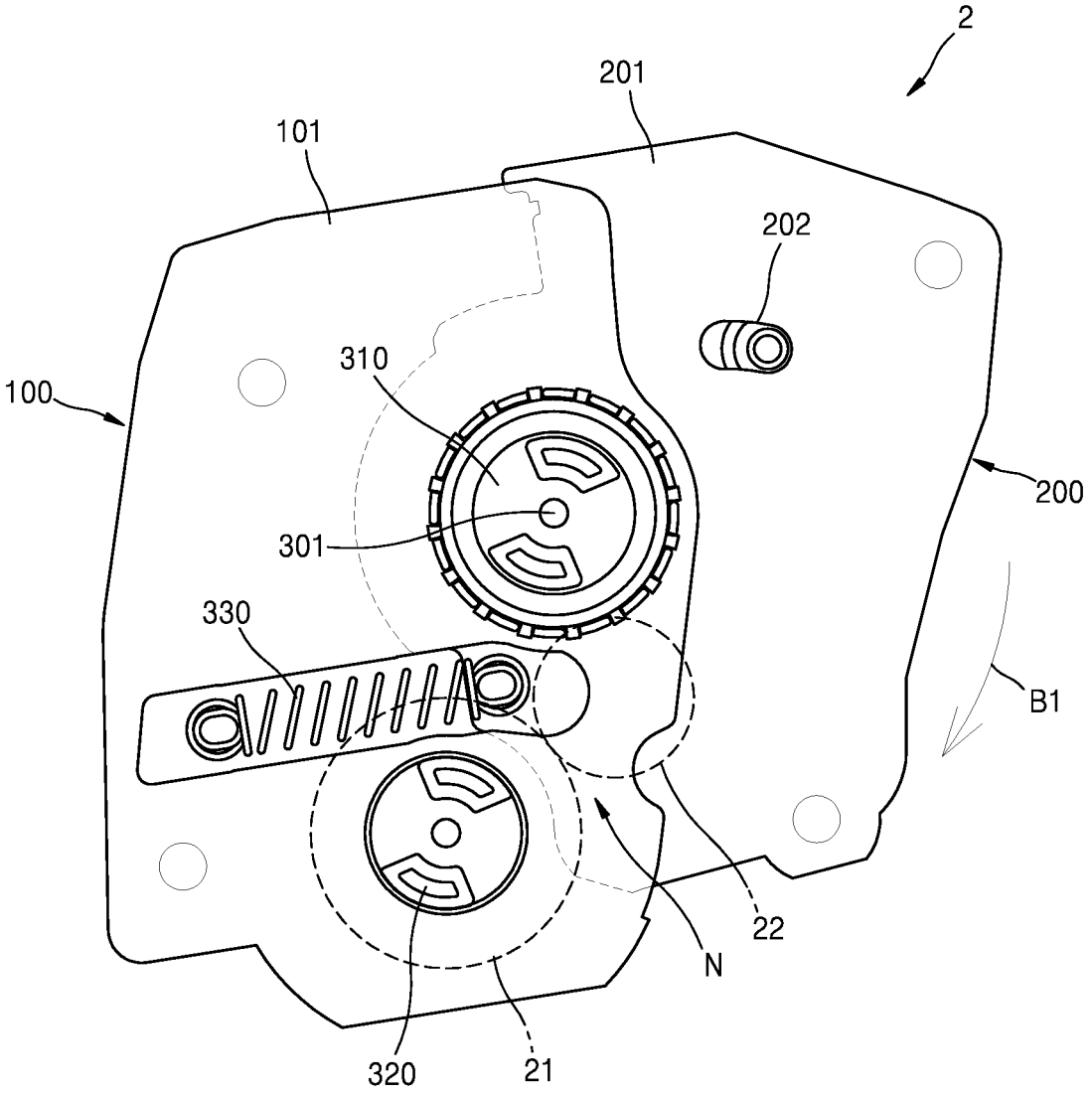
FIGS. 2 and 3 are side views each showing an example of a developing cartridge.
Figure 3:
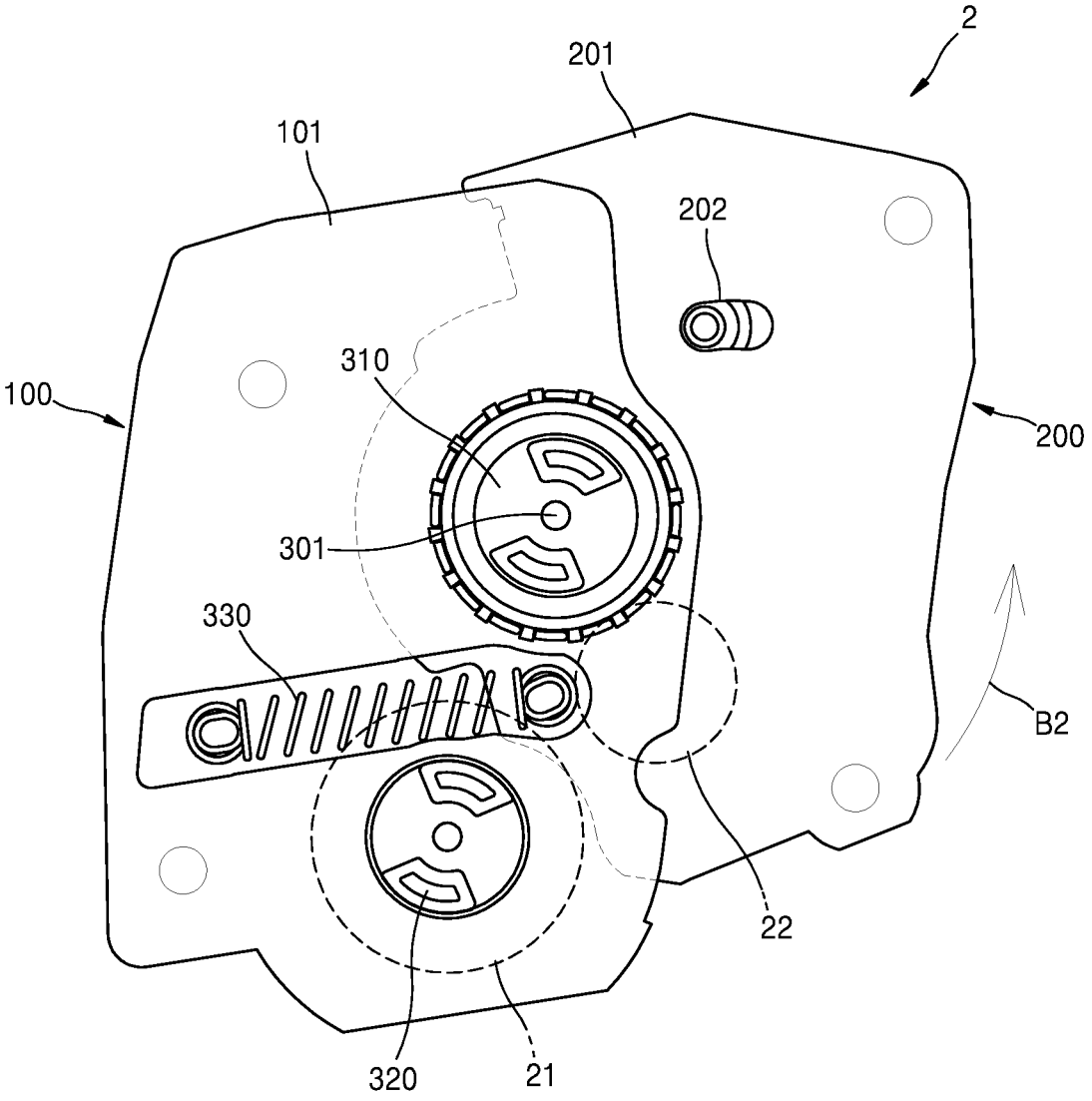

FIGS. 2 and 3 are side views each showing an example of the development cartridge 2. FIG. 2 shows a state in which the photoconductive drum 21 and the developing roller 22 contact each other and form the development nip N, and FIG. 3 shows a state in which the photoconductive drum 21 and the developing roller 22 are placed apart from each other and the development nip N is released.

Referring to FIGS. 2 and 3, the development cartridge 2 includes the photoconductive unit 100 and the developing unit 200. The photoconductive unit 100 includes a first frame 101 and the photoconductive drum 21 that is supported by the first frame 101. The developing unit 200 includes a second frame 201 and the developing roller 22 that is supported by the second frame 201.

The development nip separator 510 may have the developing roller 22 contact/placed apart from the photoconductive drum 21, and may form/release the development nip N by moving the developing unit 200. The development nip separator 510 in the example forms/releases the development nip N by moving the developing unit 200.

Referring to FIGS. 2 and 3, the developing unit 200 is connected to the photoconductive unit 100 to be turned to a development location (see FIG. 2) at which the photoconductive unit 100 and the developing roller 22 contact each other and forms the development nip N and a release location (see FIG. 3) at which the photoconductive drum 21 and the developing roller 22 are placed from each other and the development nip N is released. For example, the developing unit 200 is connected to the photoconductive unit 100 to be turned, having a hinge shaft 301 as a center, to the development location and the release location.

The rotating members of the development cartridge 2, for example, the photoconductive drum 21, the developing roller 22, the supply roller 27, and the like may be driven by being connected to a driving motor (not shown) that is provided in the main body 1 when the development cartridge 2 is attached to the main body. For example, couplers 310 and 320, which are connected to the driving motor (not shown) provided in the main body 1 when the development cartridge 2 is attached to the main body 1, may be provided in the development cartridge 2. The rotating members may be connected to the couplers 310 and 320 by power connection units that are not shown, for example, gears. The rotating members of the developing unit 200, for example, the developing roller 22, the supply roller 27, and the like may be driven by being connected to the coupler 310, and rotating members provided in the photoconductive unit 100, for example, the photoconductive drum 21, may be driven by being connected to the coupler 320.

An elastic member 330 provides elasticity for the developing unit 200 to be turned in a direction in which the development nip N is formed. Due to the elasticity of the elastic member 330, the developing roller 22 contacts the photoconductive drum 21 as the developing unit 200 is turned having the hinge shaft 301 as a center, and thus, the development nip N may be formed as shown in FIG. 2. In FIGS. 2 and 3, as an example of the elastic member 330, a tension coil spring having an end and another end respectively supported by the photoconductive unit 100 and the developing unit 200, but examples of the elastic member 330 are not limited thereto. For example, various forms of members such as a torsion coil spring, a leaf spring may be adopted as the elastic member 330.

Figure 4:
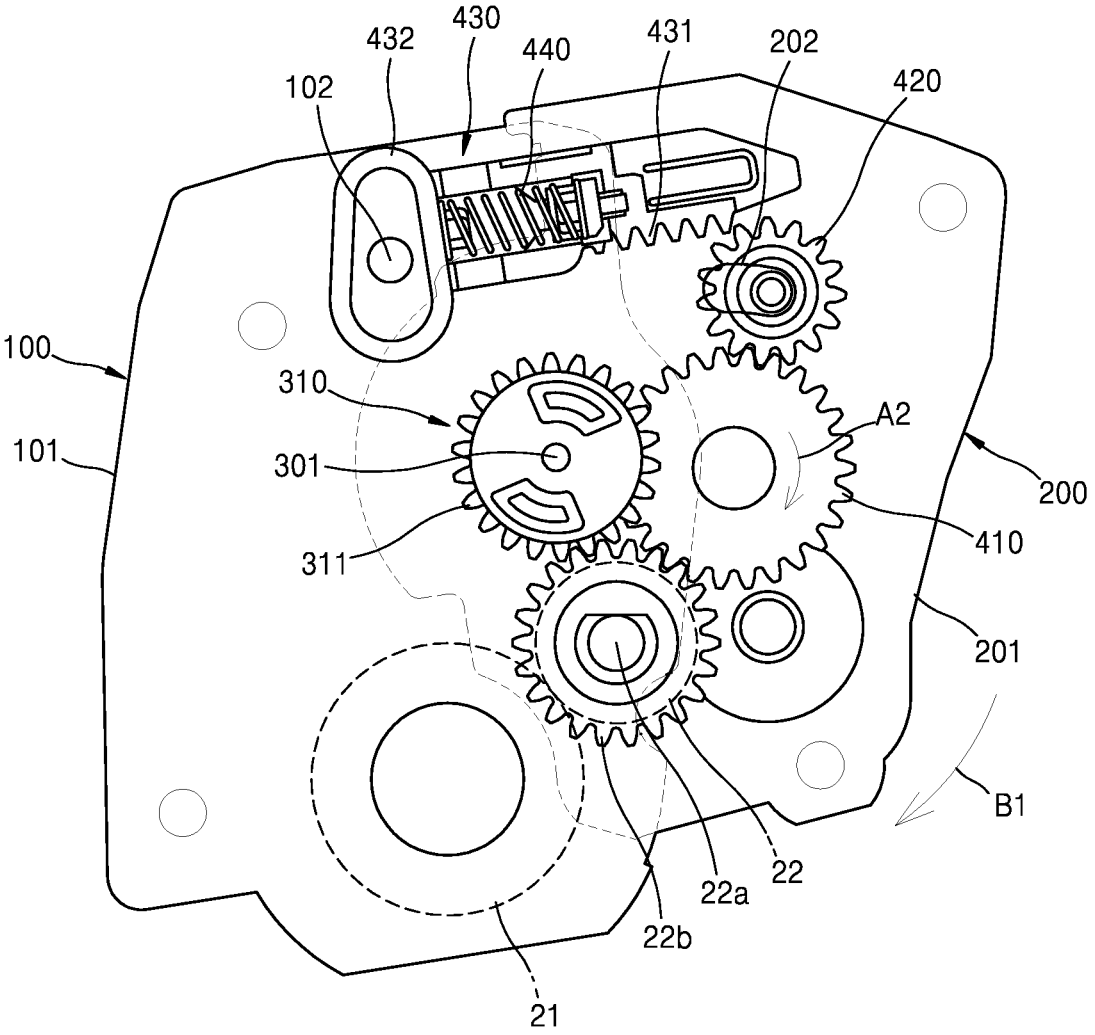
FIGS. 4 and 5 are diagrams each showing an example of a development nip separator.
Figure 5:
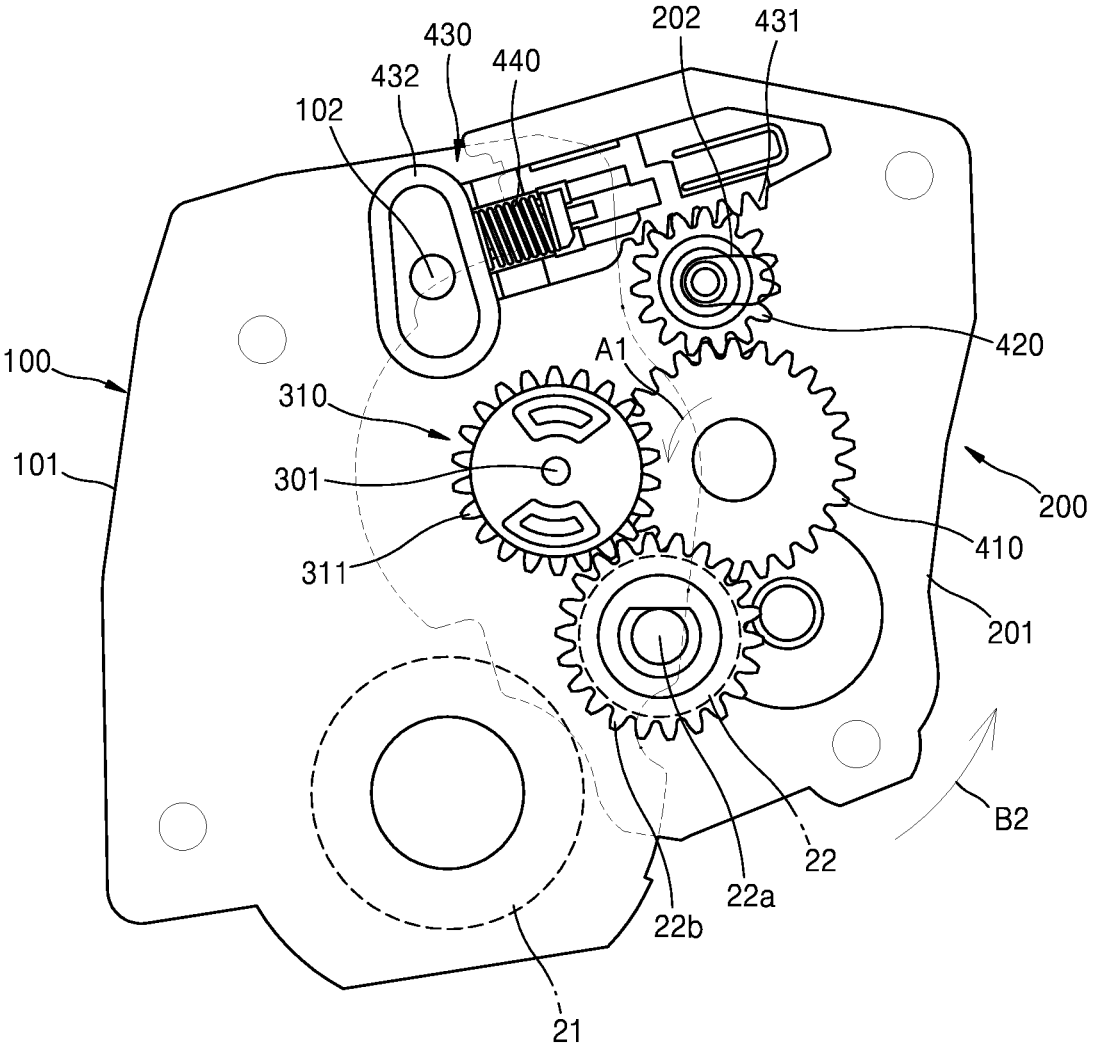

FIGS. 4 and 5 are diagrams each showing an example of the development nip separator 510. FIG. 4 shows a state in which the developing unit 200 is at the development location, and FIG. 5 shows a state in which the developing unit 200 is at the release location.

Referring to FIGS. 4 and 5, the development nip separator 510 may include a driving gear 410, a swing gear 420 that are rotated by being connected to the driving gear, and a moving member 430 that is selectively connected to the swing gear 420.

The driving gear 410 may, for example, be driven by being connected to the coupler 310. In the example, the coupler 310 includes a gear unit 311, and the gear unit 311 is engaged with a developing roller gear **22*b* that is combined with a rotation shaft 22*a* of the developing roller 22. The driving gear 410 is engaged with the developing roller gear 22*b*. By using a driving motor that is not shown, the driving gear 410 is rotated in a first direction A1 in a non-printing mode, and is rotated in a second direction A2** in a printing mode.

The moving member 430 turns the developing unit 200, having the hinge shaft 301 as a center, to the development location and the release location. To do so, the moving member 430 is placed in the developing unit 200, for example, the second frame 201, to be moved to the first location and the second location respectively corresponding to the release location and the development location. The moving member 430 includes a rack gear unit 431. The moving member 430 is moved to the first location and the second location according to a rotation direction of the driving gear 410.

The swing gear 420, as the driving gear 410 is rotated to the first direction A1 and the second direction A2, is swung to a third location (FIG. 5) where the swing gear 420 is connected to the rack gear unit 431 and moves the moving member 430 from the second location to the first location, and a fourth location (see FIG. 4) where the swing gear 420 is placed apart from the rack gear unit 431 and allows the moving member 430 to be moved from the first location to the second location. A guide unit 202 may be provided in the developing unit 200, for example, the second frame 201, such that the swing gear 420 may be swung to the third location and the fourth location. The guide unit 202 may have the form of, for example, a long hole. The moving member 430 includes a second connection unit 432 that is connected to a first connection unit 102 provided in the photoconductive unit 100, for example, the first frame 101. For example, the first connection unit 102 may have the form of a protrusion, and the second connection unit 432 may have the form of a ring into which the first connection unit 102 is inserted. The forms of the first connection unit 102 and the second connection unit 432 are not limited to the example shown in FIG. 4.

The development nip separator 510 may further include a return spring 440. The return spring 440 provides, to the moving member 430, elasticity having a direction in which the moving member 430 member is maintained to be at the second location. For example, the return spring 440 may be a compression coil spring having an end and another end respectively supported by the developing unit 200, for example, the second frame 201 and the moving member 430, however the return spring 440 is not limited thereto, and various springs such as a tension coil spring, a torsion spring, and a leaf spring may be adopted as the return spring 440.

Referring to FIGS. 4 and 5, a process of forming/release the development nip N is described.

In FIG. 4, the developing unit 200 is at the development location, the moving member 430 is at the second location, and the swing gear 420 is at the fourth location. For printing, a motor (not shown) provided in the main body 1 is rotated in a forward direction, and torque of the motor is transmitted to the driving gear 410 via the coupler 310, and thus, the driving gear 410 is rotated in the second direction A2. By doing so, the swing gear 420 is moved to the fourth location as shown in FIG. 4, and is maintained in a state of being placed apart from the rack gear unit 431. Accordingly, the printing operation may be performed in the state where the moving member 430 is held at the second location and the development nip N is formed.

In a non-printing mode, the motor (not shown) provided in the main body 1 is rotated in a reverse direction, and the torque of the motor is transmitted to the driving gear 410 via the coupler 310, and the driving gear 410 is rotated in the first direction A1. By doing so, the swing gear 420 is swung to the third location as shown in FIG. 5 and engaged with the rack gear unit 431. When the driving gear 410 is rotated in the first direction A1, the swing gear 420 is rotated in a state of being engaged with the rack gear unit 431. The moving member 430 is slid from the second location to the first location, and the second connection unit 432 pulls the first connection unit 102. As the location of the photoconductive unit 100 is fixed, the developing unit 200 is turned, in the direction B2 indicated with an arrow mark, having the hinge shaft 301 as a center. As shown in FIGS. 3 and 5, when the moving member 430 reaches the third location, the developing unit 200 reaches the release location, and the developing roller 22 is moved apart from the photoconductive drum 21, and thus, the development nip N is release.

In a state shown in FIG. 5, when the motor is rotated in the forward direction for printing, the torque of the motor is delivered to the driving gear 410 via the coupler 310, and the driving gear 410 is rotated in the second direction A2. By doing so, the swing gear 420 is swung to the fourth location as shown in FIG. 4, and the developing unit 200 is turned to the direction B1 indicated with an arrow mark by the elasticity of the elastic member 330. As the first connection unit 102 and the second connection unit 432 are connected to each other, the moving member 430 is slid to the second location. When the moving member 430 reaches the second direction, the swing gear 420 is moved apart from the rack gear unit 431. Accordingly, the printing operation may be performed in the state where the moving member 430 is held at the second location and the development nip N is formed.

Referring again to FIG. 1, light L emitted from the exposure unit 13 is incident to the photoconductive drum 21. As the printing operation is not performed when the development nip N is released, the light L may be blocked by a light blocking member 520. For example, the light blocking member 520 may be moved to a position where the light L is passed (a position marked with a solid line in FIG. 1) and to a position where the light L is blocked (a position marked with a broken line in FIG. 1), in conjunction with operations of the developing roller 22 that is attached to/separated from the photoconductive drum 21 by using the development nip separator 510. For instance, in the example, the light blocking member 520 is connected to the developing unit 200, and is placed at a location for blocking the light L when the developing unit 200 is turned to the release location by the development nip separator 510. When the developing unit 200 is moved back to the development location, the light blocking member 520 is moved back to a location for allowing penetration of the light L. A light path 501 is formed between the photoconductive unit 100 and the developing unit 200, and the light blocking member 520 may block the light path 501 when the developing unit 200 is turned to the release location. The light blocking member 520 may be a part of the developing unit 200, for example, a part of the second frame 201.

Structure of the development nip separator 510 is not limited to the examples shown in FIGS. 4 and 5. For example, the development nip separator 510 may have a structure disclosed in U.S. Pat. No. 8,909,898. In addition, the light blocking member 520 is not limited to the example shown in FIG. 1. As it is disclosed in U.S. Pat. No. 8,909,089, a structure that opens/blocks a light window 13*a* of the exposure unit 13, in conjunction with formation/release operations of the development nip N, may be used as the light blocking member 520.

It is necessary to determine whether the operation of forming/releasing the development nip N is normally performed. Formation of the development nip N may be confirmed by an auto-density control process that is performed when a new development cartridge 2 is attached to the main body 1. For example, the controller 500 forms a test pattern, for auto-density control, in the photoconductive drum 21. The test pattern is a visible toner image that is transferred onto a surface of the photoconductive drum 21. The controller 500 detects the test pattern, by using an image density sensor, and adjusts print parameters such as a developing bias voltage such that the detected image density is a target density. When the developing roller 22 does not contact the photoconductive drum 21, the visible toner image is not formed on the surface of the photoconductive drum 21. Accordingly, the controller 500 may, based on the detected image density, detect whether the development nip N is formed.

It is necessary to check whether the operation of releasing the development nip N is normally performed to promote effects such as preventing damage to the developing roller 22 and the photoconductive drum 21, improve the quality of images, and lengthen the life of the image forming apparatus.

Referring to FIG. 1, in the example, when the development nip N is released, light L irradiated from the exposure unit 13 to the photoconductive drum 21 is blocked by the light blocking member 520 that is linked to the development nip separator 510. The photoconductive drum 21 is charged, by the charging roller 23, to have a uniform surface potential, and after exposure, the surface potential of the photoconductive drum 21 is changed. Accordingly, release of the development nip N may be detected based on the change in the surface potential of the photoconductive drum 21.

When charging and exposure operations are performed in a state where the development nip N is successfully released, the light blocking member 520 is moved to a location marked with a broken line shown in FIG. 1 and blocks the light L. Accordingly, the photoconductive drum 21 is not exposed, and the surface potential of the photoconductive drum 21 is maintained in a charged state. For example, the power supply unit 530 provides a charging bias voltage to the charging roller 23 such that the photoconductive drum 21 has a uniform surface potential. A surface potential Vd1 to detect release of the development nip may be identical to or different from a surface potential Vd0 in the image forming operation. For example, the surface potential Vd1 may be set as −600V that is equal to the surface potential Vd0. When the exposure operation is performed in the above-mentioned state, the light L is blocked by the light blocking member 520, and thus, the surface potential of the photoconductive drum 21 is maintained as −600V, that is, a potential in a charging mode.

Even after the development nip separator 510 is driven by the controller 500 to release the development nip N, the development nip N may not be released due to electrical, mechanical factors. When the charging and exposure operations are performed in the above-mentioned state, the light blocking member 520 is moved to a location marked with a solid line in FIG. 1, and the light L is not blocked. Accordingly, the photoconductive drum 21 is exposed, and the surface potential of the photoconductive drum 21 is changed. For example, the surface potential of the photoconductive drum 21 is changed to −100 V that is a latent potential V1. Accordingly, the controller may determine whether the development nip N is normally released, based on a surface potential (a first surface potential) of the photoconductive drum 21 after charge or charge and exposure in a state where the development nip N is formed and a surface potential (a second surface potential) of the photoconductive drum 21 after charging and exposure after controlling the development nip separator 510 to release the development nip N.

Figure 6:
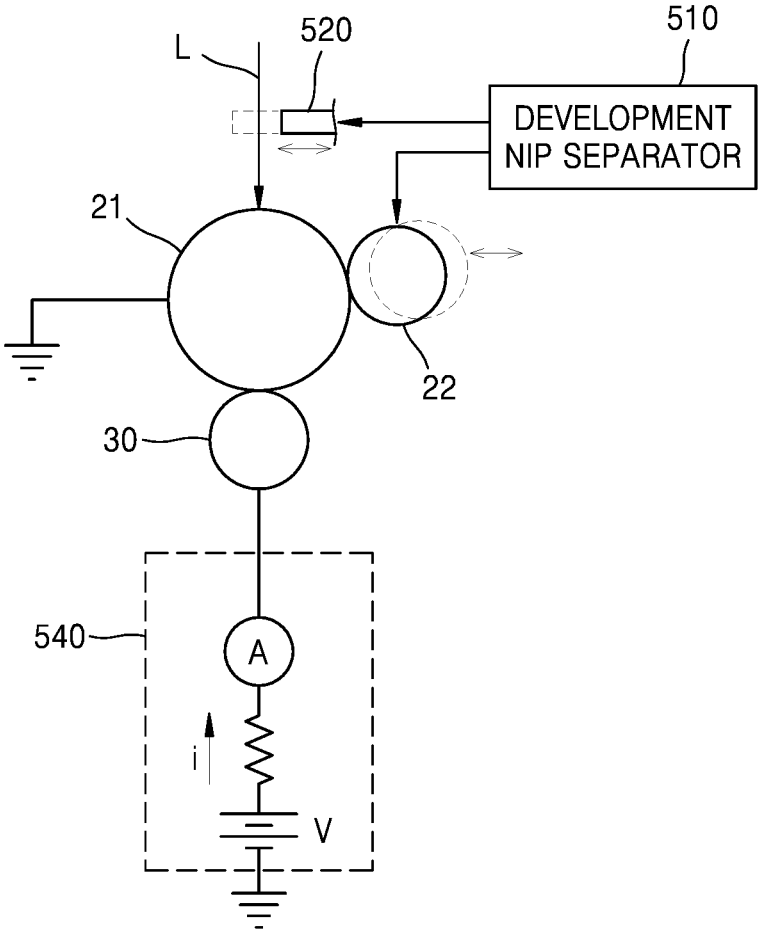
FIG. 6 is a diagram schematically showing an example of a load measuring unit.

The change in the surface potential of the photoconductive drum 21 may be detected by measuring a load of a transfer system including the photoconductive drum 21 and the transfer roller 30. In the example, there is provided a load measuring unit 540 that measures the load of the transfer system. The load measuring unit 540 may, as shown in FIG. 6A, include a current measuring circuit that applies a constant voltage to the transfer roller 30 as a sensing bias voltage and measures a current flowing through the transfer system. The constant voltage may be supplied from the power supply unit 530. The intensity of the current that is measured is inversely proportional to the load of the transfer system. Accordingly, the load of the transfer system may be measured by measuring the current flowing through the transfer system. For example, the load measuring unit 540 may output a voltage signal that is proportional to the intensity of the current, and the controller 500 may calculate the load of the transfer system from the voltage signal or obtain, from a lookup table, a load value that corresponds to the voltage signal. Although it is not shown, the load measuring unit 540 may include a voltage measuring circuit that applies a constant current to the transfer roller 30 as a sensing bias current and measures a voltage applied to the transfer system. The constant voltage may be supplied from the power supply unit 530. The intensity of the voltage that is measured is proportional to the load of the transfer system. Accordingly, the load of the transfer system may be measured by measuring the voltage that is applied to the transfer system.

For example, when the constant voltage V as a sensing bias is applied to the transfer roller 30, the current i flowing through the transfer system is influenced by the surface potential of the photoconductive drum 21. For example, when the surface potential of the photoconductive drum 21 that is charged is −600 V and the sensing bias voltage is +700 V, the potential difference between the photoconductive drum 21 that is not exposed and the transfer roller 30 is 1300 V. In this state, the load of the transfer system (a reference load A) may be measured by measuring the current i flowing through the transfer system.

When the development nip N is normally released, the photoconductive drum 21 is not exposed, and thus, the potential difference between the photoconductive drum 21 and the transfer roller 30 is maintained at 1300 V. Accordingly, the current i flowing through the transfer system is not changed, which means the load of the transfer unit (a detected load B) is equal or similar to the reference load A).

When the development nip N is not normally released and the photoconductive drum 21 is exposed, the surface potential of the photoconductive drum 21 is −100 V, and thus, potential difference between the photoconductive drum 21 and the transfer roller 30 is 800 V. Accordingly, the current i flowing through the transfer system decreases, which means the detected load B became greater than the reference load A.

Table 1 shows a result of measuring the reference load A and the detected load B when the development nip N is formed/released.

TABLE 1

| Surface Potential | Sensing bias voltage (V) | Command to release the development nip | State of the development nip | Load of the transfer system (MΩ) | | A/B |
|---|---|---|---|---|---|---|
| −600 V | +700 V | Formed | Formed | A | 37.7 | — |
| | | Released | Formed | B | 58.0 | 0.650 |
| | | Released | Released | B | 39.7 | 0.949 |

Referring to Table 1, when the development nip N is normally released, a gap between the reference load A and the detected load B is 2 MΩ, but when the development nip N is not released, a gap between the reference load A and the detected load B is 20.3 MΩ. Accordingly, it is possible to detect whether the development nip N is normally released by comparing the detected load B to the reference load A.

The load of the transfer system may differ according to electrical properties of members, including the transfer roller 30, that are included in the transfer system. Table 2 shows another result of measuring the reference load A and the detected load B when the development nip N is formed/released.

TABLE 2

| Surface Potential (Vd1) | Sensing bias voltage (V) | Command to release the development nip | State of the development nip | Load of the transfer system (MΩ) | | A/B |
|---|---|---|---|---|---|---|
| −600 V | +700 V | Formed | Formed | A | 93.9 | — |
| | | Released | Formed | B | 139.5 | 0.673 |
| | | Released | Released | B | 101.2 | 0.927 |

Referring to FIG. 2, when the development nip N is normally released, a gap between the reference load A and the detected load B is 7.3 MΩ, but when the development nip N is not released, a gap between the reference load A and the detected load B is 45.6 MΩ.

As disclosed in Tables 1 and 2, it is not easy to determine whether the development nip N is released only by using the gap between the reference load A and the detected load B. However, in Tables 1 and 2, the values of A/B are similar to each other as 0.949 and 0.927 when the development nip N is normally released and similar to each other as 0.650 and 0.673 when the development nip N is not released. Accordingly, it is possible to detect whether the development nip N is normally released based on a ratio of the reference load A and the detected load B. For example, the controller 500 may determine that the development nip N is normally released when a value of A/B is greater than 0.85.

Figure 7:
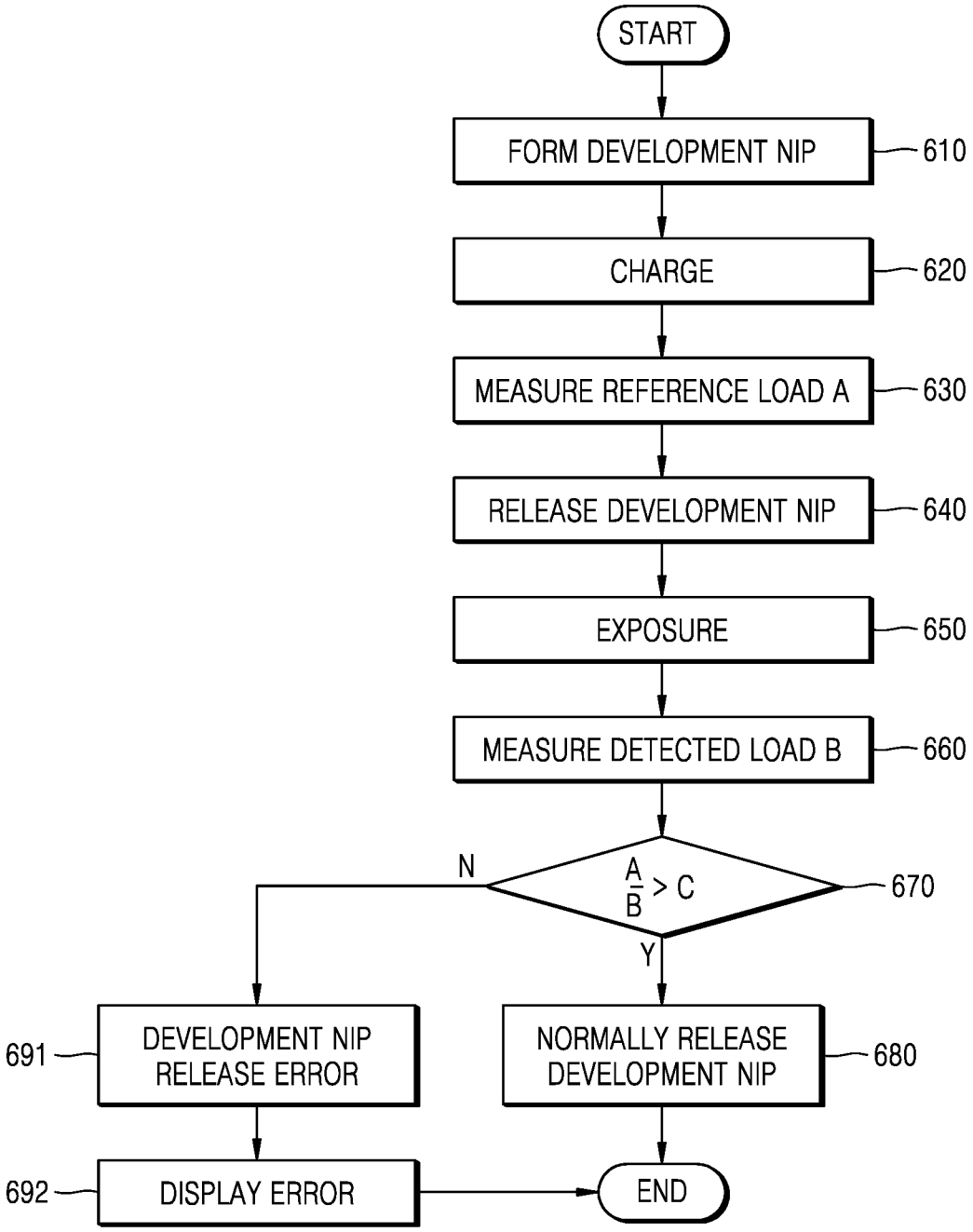
FIG. 7 is a flowchart showing an example of a method of detecting whether the development nip is released.

FIG. 7 is a flowchart showing an example of a method of detecting whether the development nip N is released. Referring to FIG. 7, a process of detecting whether the development nip N is released is described.

The controller 500 controls the development nip separator 510 and forms the development nip N (S610). The controller 500 charges the photoconductive drum 21 by controlling the power supply unit 530 to apply a charging bias voltage to the charging roller 23 (S620). For example, the surface potential Vd1 of the photoconductive drum 21 may be −600 V. The controller 500 controls the power supply unit 530 and the load measuring unit 540 to measure the reference load A. For example, a voltage of +700 V is applied, as a sensing bias voltage, from the power supply unit 530 to the transfer roller 30, and the load measuring unit 540 measures the current flowing through the transfer system. The controller 500 measures the reference load A from the measured current value (S630).

Next, the controller 500 controls the development nip separator 510 to perform operation of releasing the development nip N (S640). Next, the controller 500 irradiates the light L to the photoconductive drum 21 by using the exposure unit 13 (S650) and measures the detected load B (S660).

The controller 500 determines whether the development nip N is normally released by comparing the ratio of the reference load A and the detected load B to a certain reference value C (S670). The reference value C may, for example, be previously set in a memory. For example, when the value of A/B is greater than 0.85, the controller 500 may determine that the development nip N is normally released (S680). When the value of A/B is equal to or less than 0.85, the controller 500 may determine that the development nip N is not released (S691). In this case, the controller 500 may display an error message by using, for example, a display, a blinker, a beeper, and the like (S692). The error message may include a message that commands replacement of the development cartridge 2.

Figure 8:
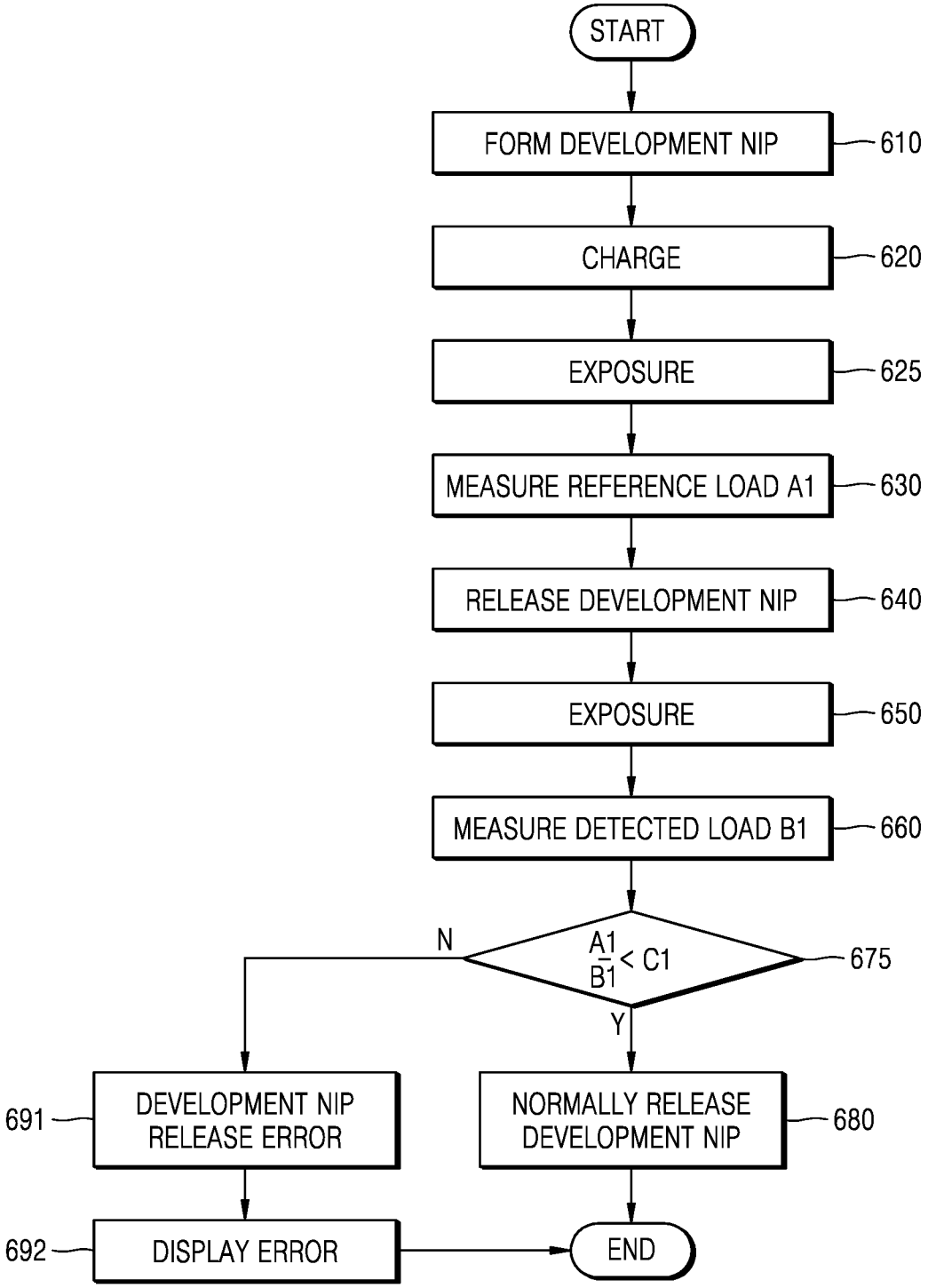
FIG. 8 is a flowchart showing an example of a method of detecting whether the development nip is released.

FIG. 8 is a flowchart showing an example of a method of detecting whether the development nip N is released. The method shown in FIG. 8 is identical to the method shown in FIG. 7 except the exposure is performed (S625) in a state where the development nip N is formed before measuring the reference load A1.

Accordingly, the controller 500 may determine whether the development nip N is normally released by comparing the ratio of the reference load A1 and a detected load B1 to a reference value C1 that is set in advance (S675). However, as the detected load B1 when the development nip N is normally released is less than the reference load A1, in the operation S675 of determining whether the development nip N is released, for example, when a value of A1/B1 is less than the C1, the controller 500 may determine that the development nip N is normally released (S680). When the value of A1/B1 is equal to or greater than the C1, the controller 500 may determine that the development nip N is not released (S691). In this case, the controller 500 may display an error message by using, for example, a display, a blinker, a beeper, and the like (S692).

In the above-mentioned example, when charging the photoconductive drum 21 to detect release of the development nip N, the surface potential Vd1 is set to be equal to the surface potential Vd0 when the image is formed, but scope of the present disclosure is not limited thereto. To increase accuracy in the detection, an absolute value of the surface potential Vd1 may be set to be greater than the surface potential Vd0 in the image forming mode. As the difference between the surface potential Vd1 and a latent potential V1 increases, measurement resolution of the load of the transfer system increases. Increasing the absolute value of the surface potential Vd1 or decreasing the absolute value of the latent potential V1 may be considered, but it is difficult to change the latent potential V1 that has to change intensity of the light L. The surface potential Vd1 may be easily changed by changing a magnitude of the charging bias voltage. Accordingly, measurement resolution may be increased by making the absolute value of the surface potential Vd1 greater than the absolute value of the surface potential V0 when the image is formed.

Figure 9:
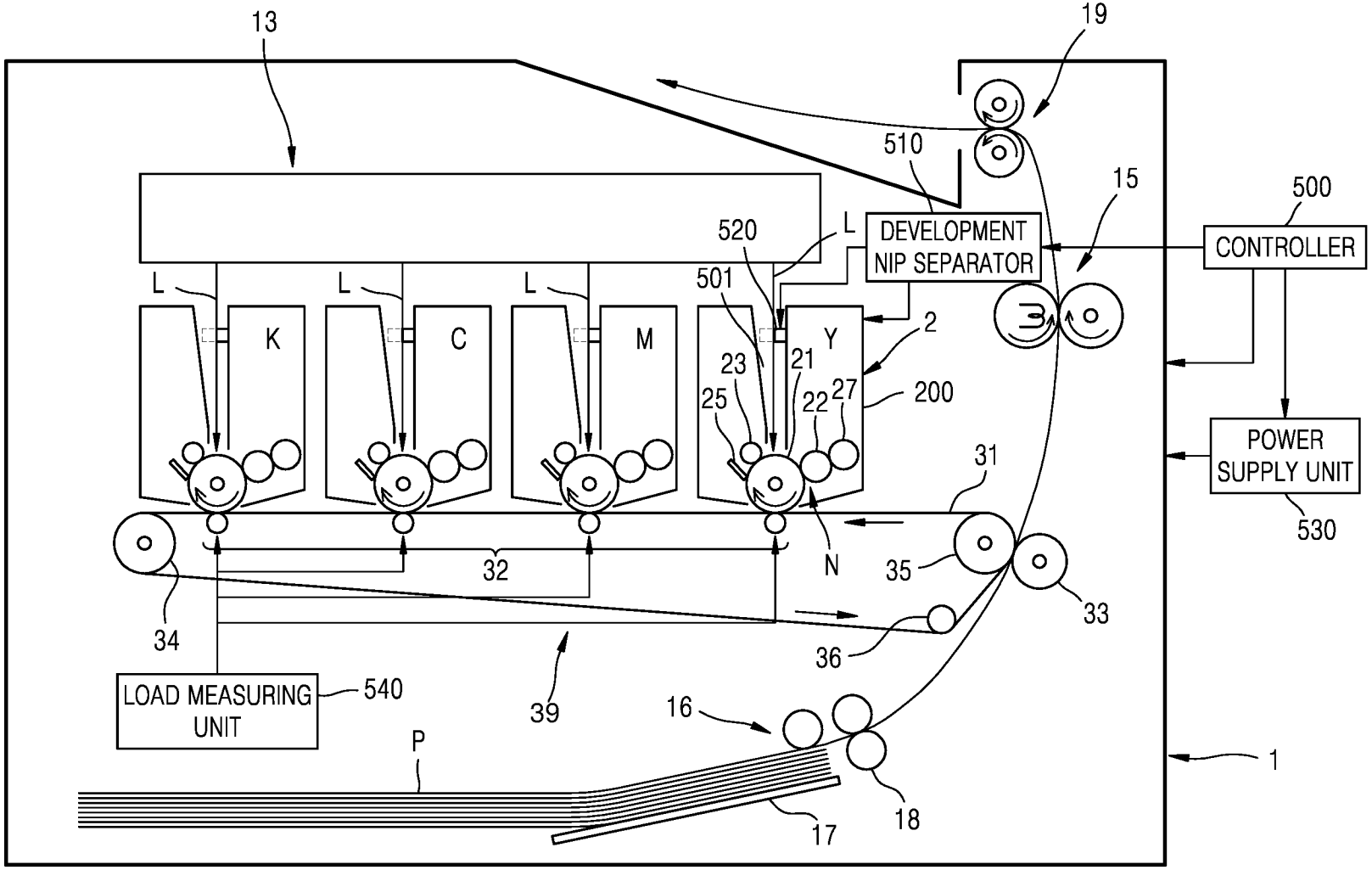
FIG. 9 is a diagram schematically showing an example of an electrophotographic image forming apparatus.

The above-mentioned method of detecting release of the development nip N may also be applied to a color image forming apparatus. FIG. 9 is a diagram schematically showing an example of an electrophotographic image forming apparatus. The image forming apparatus in the example, by the electrophotographic method, prints a color image on the recording medium P.

Referring to FIG. 9, the image forming apparatus may include the main body 1 and the plurality of development cartridges 2. The plurality of development cartridges 2 is attached to/detached from the main body 1. The exposure unit 13, the transfer unit 39, and the fixing unit 15 is provided in the main body 1. In addition, the recording medium transporting unit, which is used to load and transport the recording medium P in which an image is formed, is provided in the main body 1.

As the development cartridge 2 in the example is identical to the development cartridge 2 shown in FIG. 1, overlapping descriptions will not be given. For color printing, the plurality of development cartridge 2 may, for example, include four development cartridges 2 to develop images having cyan (C) color, magenta (M) color, yellow (Y) color, and black (K) color. Toners of cyan (C) color, magenta (M) color, yellow (Y) color, and black (K) color may respectively be accommodated in the four development cartridges 2. Although it is not shown, toners of cyan (C) color, magenta (M) color, yellow (Y) color, and black (K) color are respectively accommodated in four toner supplying containers, and the toners of cyan (C) color, magenta (M) color, yellow (Y) color, and black (K) color may respectively be supplied from the four toner supplying containers to four development cartridges 2. The image forming apparatus may further include development cartridges 2 to accommodate and develop toners having various colors such as light magenta and white except for the colors described above. The image forming apparatus including four development cartridges 2 are described below, and unless particularly mentioned, reference numbers, to which C, M, Y, and K are added, indicate components to develop images of cyan (C) color, magenta (M) color, yellow (Y) color, and black (K) color.

The transfer unit 39 may include an intermediate transfer belt 31, a transfer roller 32, and a secondary transfer roller 33. Toner images developed on the photoconductive drums 21 of the development cartridges 2C, 2M, 2Y, and 2K are temporarily transferred onto the intermediate transfer belt 31. The intermediate transfer belt 31 is supported by support rollers 34, 35 and 36 and circulated. Four transfer rollers 32 are placed to face the photoconductive drums 21 included in each of the development cartridges 2C, 2M, 2Y, and 2K, having the intermediate transfer belt 31 between the transfer rollers 32 and the photoconductive drums 21. A primary transfer bias voltage is applied to the four transfer rollers 32 to primarily transfer the toner image, which is developed on the photoconductive drum 21, to the intermediate transfer belt 31. A Corona transfer unit or a pin-scorotron type transfer unit may be adopted instead of the transfer roller 32. The secondary transfer roller 33 is placed to face the intermediate transfer belt 31. A secondary transfer bias voltage is applied to the secondary transfer roller 33 to transfer the toner image, which is primarily transferred onto the intermediate transfer belt 31, to the recording medium P.

When a print command is received from a host that is not shown, and the like, the controller 500, by using the charging roller 23, charges the surface of the photoconductive drum 21 to have a uniform potential. The exposure unit 13 irradiates four light beams, which are modulated to correspond to image data of the colors, to the photoconductive drums 21 of the development cartridges 2C, 2M, 2Y, and 2K, thereby forming electrostatic latent images on the photoconductive drums 21. The developing rollers 22 of the development cartridges 2C, 2M, 2Y, and 2K supply C toner, M toner, Y toner, and K toner respectively to the corresponding photoconductive drums 21, thereby developing the electrostatic latent images into visible toner images. The toner images that are developed are primarily transferred onto the intermediate transfer belt 31. The recording medium P loaded on the loading stand 17 is taken out sheet by sheet by using the pickup roller 16 and is, by using the feed roller 18, transported to the transfer nip that is formed by the secondary transfer roller 33 and the intermediate transfer belt 31. The toner images that are primarily transferred onto the intermediate transfer belt 31 are secondarily transferred onto the recording medium P by using the secondary transfer bias voltage that is applied to the secondary transfer roller 33. When the recording medium P passes through the fixing unit 15, the toner images are, due to heat and pressure, fixed on the recording medium P. The recording medium P, on which the toner images are fixed, is taken out by the discharge roller 19.

The image forming apparatus of the example includes the development nip separator 510 that forms/releases the development nip N by having the developing roller 22 attached to/separated from the photoconductive drum 21, and the light blocking member 520 that blocks the light L when the development nip N is released. Structures of the development nip separator 510 and the light blocking member 520 may be the same as the examples shown in FIGS. 1, 4, and 5. The development nip separator 510 and the light blocking member 520 may be placed in each of the four development cartridges 2. In addition, as described above, the light blocking member 520 may open/close light windows of the exposure unit 13 in conjunction with an operation of the development nip separator 510.

The load measuring unit 540 may, as described above, include a current detection circuit or a voltage detection circuit, and the controller 500 may calculate the reference load A and the detected load B from the output signal of the load measuring unit 540.

The color image forming apparatus in the example includes four transfer systems. The load measuring unit 540 may, after charging or after charging and exposure, measure the reference load A and the detected load B for the four transfer systems. The controller 500 may, by comparing the ratio of the reference load A and the detected load B to the reference value C, determine whether all the four development nip N are normally released or at least one of the four development nips N is not released.

To increase resolution in measuring the load of the transfer system, the absolute value of the surface potential Vd1 may be set to be greater than the absolute value of the surface potential Vd0 when the image is formed. For example, Table 3 shows an example of a result of measuring the load of the transfer system when the surface potential Vd1 is changed. Table 3 shows a result of setting the surface potential Vd1 as −600 V and −700 V and measuring the reference load A and detected load B. A part marked with the Italic font shows a measurement result when only one of the four development nip N is not normally released.

TABLE 3

| Surface Potential (Vd1) | Sensing bias voltage (V) | Command to release the development nip | State of the development nip | Load of the transfer system (MΩ) | | A/B |
|---|---|---|---|---|---|---|
| −600 V | +700 V | Formed | Formed | A | 12.4 | — |
| | | *Released* | *Formed* | *B* | *14.0* | *0.885* |
| | | Released | Released | B | 13.0 | 0.952 |
| −700 V | +700 V | Formed | Formed | A | 10.5 | — |
| | | *Released* | *Formed* | *B* | 13.4 | 0.784 |
| | | Released | Released | B | 10.8 | 0.971 |

As it is shown in Table 3, when the surface potential Vd1 is increased, a difference between the A/B values of the case in which the development nip is normally released and a case that is opposite thereto increases, and thus, release errors may be accurately detected when one of the four development nips N is not normally released.

Figure 10:
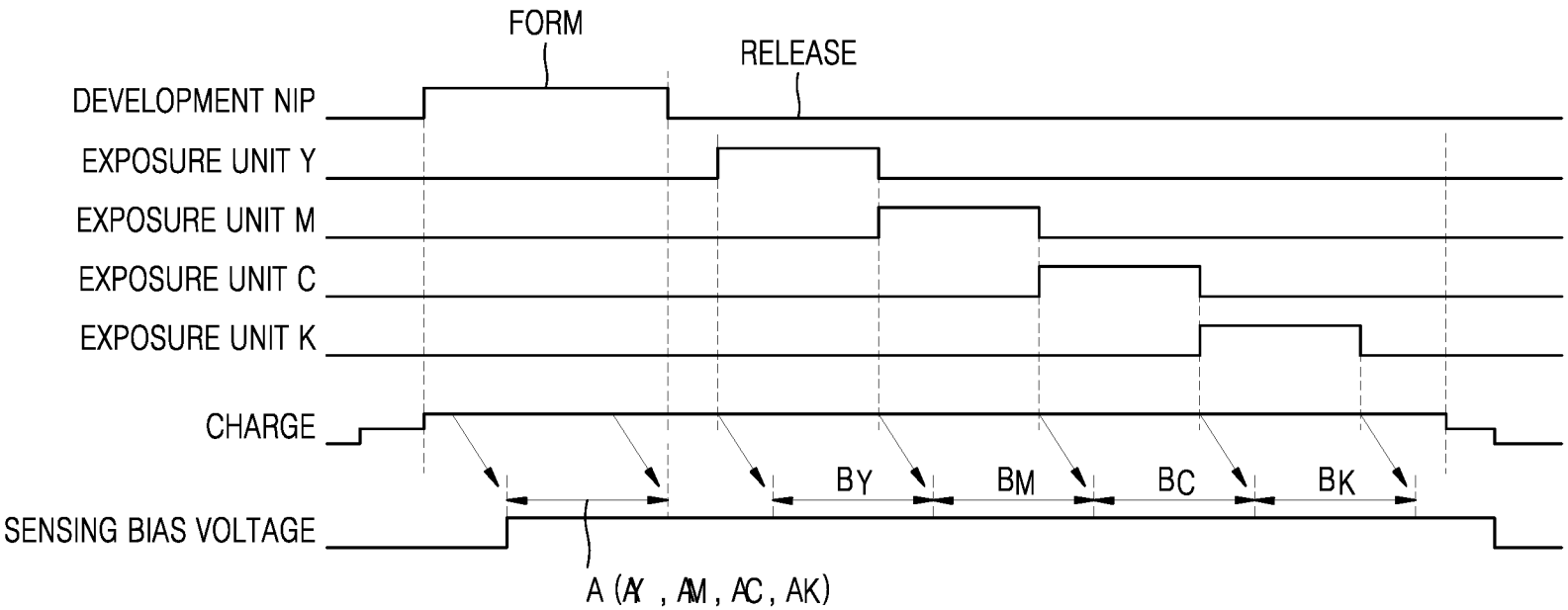
FIG. 10 is a timing chart showing an example of a method of detecting whether the development nip is released.

To identify which one of the four development nips N is not normally released, the controller 500 may calculate a reference load A and a detected load B for each of the four transfer units. FIG. 10 is a timing chart showing a process of measuring the reference load A and the detected load B. Referring to FIGS. 7 and 10, a process of detecting whether the development nip N is released is described.

Referring to FIG. 10, the controller 500 charges the four photoconductive drums 21 to each have a surface potential Vd1, in a state where the development nip N is formed, and controls the load measuring unit 540 to measure the reference loads A for the four photoconductive drums 21. The surface potential Vd1 may be equal to the surface potential Vd0 when the image is formed, and to increase the measuring resolution, may be higher than the surface potential Vd0 when the image is formed. The reference load A may include reference loads $A_Y$, $A_M$, $A_C$, and $A_K$ for the four photoconductive drums 21.

Next, the controller 500 drives the development nip separator 510 and releases the development nip N. Next, the controller 500 irradiates the light L to the four photoconductive drums 21 by using the exposure unit 13 and measures the detected load B. The detected load B may include loads $B_Y$, $B_M$, $B_C$, and $B_K$ for the four transfer systems. Time points at which the light L is irradiated to the four photoconductive drum 21 by using the exposure unit 13 may be different from one another. In addition, time periods in which the light L is irradiated to the four photoconductive drum 21 by using the exposure unit 13 may not overlap one another. As shown in FIG. 10, the exposure unit 13 consecutively irradiates the light L to the four photoconductive drums 21. When a sensing bias is applied to the four transfer rollers 32, at a time point at which the parts to which the light L irradiated of each photoconductive drum 21 reaches the location to face the corresponding transfer roller 32, the detected loads $B_Y$, $B_M$, $B_C$, and $B_K$ are consecutively measured by the load measuring unit 540.

The controller 500 may determine whether the four development nips N are normally released by ratios between the reference loads $A_Y$, $A_M$, $A_C$, and $A_K$ and the detected loads $B_Y$, $B_M$, $B_C$ and $B_K$ respectively corresponding thereto.

Figure 11:
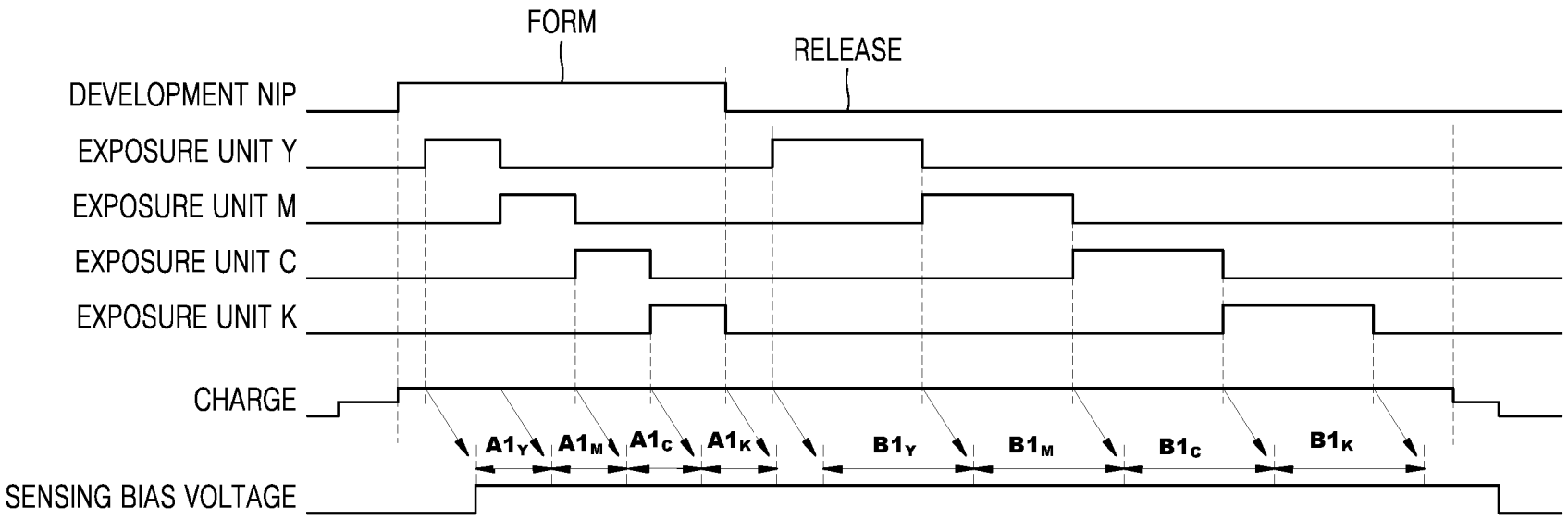
FIG. 11 is a timing chart showing an example of a method of detecting whether the development nip is released.

FIG. 11 is a timing chart showing a process of measuring the reference loads and the detected loads, and is different from the timing chart shown in 10 in that the reference loads A1Y, A1M, A1C, and MK are measured after exposing the corresponding four photoconductive drums 21. Referring FIGS. 8 and 11, the controller 500 may determine whether the development nip N is normally released by comparing the ratios between the reference loads A1 (A1Y, A1M, A1C, and A1K) and the detected loads B1 (B1Y, B1M, B1C, and Bln to the reference values C1 (C1Y, C1M, C1C, and C1K) that are previously set.

In FIGS. 10 and 11, the detected loads $B1_Y$, $B1_M$, $B1_C$, and $B1_K$ are measured at different exposure time points for the photoconductive drums 21 after controlling the development nip separator 510 to release all of the four development nips N, but scope of the present disclosure is not limited thereto. When the development nip separator 510 has a structure in which the four developing rollers 22 may be attached to/separated from the corresponding photoconductive drums 21 respectively, the development nip separator 510 may be driven to consecutively release the four development nips N, and the detected loads $B1_Y$, $B1_M$, $B1_C$, and $B1_K$ for the four transfer systems may be consecutively measured.

As described above, it is possible to detect whether the development nip N is normally released without using extra mechanical devices and sensors. Accordingly, increase in price of the image forming apparatus may be controlled. In addition, by detecting whether the development nip N is normally released, degradation of quality due to development nip release error and decrease in life of the development cartridge 2 may be prevented. In addition, when the development cartridge 2 is replaced with a new cartridge, defectiveness of the development cartridge 2 may be identified through an image density adjustment process and a development nip release detection process.

While the present disclosure has been particularly shown and described with reference to examples shown in the drawings, the examples are used in a descriptive sensed, and it will be understood by one of ordinary skill in the art that various changes in form and equivalent examples may be made without departing from scope of the present disclosure. Therefore, the scope of the present disclosure is defined by the appended claims.

What is claimed is:

1. An image forming apparatus comprising:

a photoconductor;

a charging member to charge the photoconductor;

an exposure unit to expose the photoconductor to light and form an electrostatic latent image on the photoconductor;

a developing roller to provide toner to the electrostatic latent image and develop the electrostatic latent image;

a development nip operator to move the developing roller to a first location where the developing roller contacts the photoconductor and forms a development nip and a second location where the developing roller is moved away from the photoconductor and the development nip is released;

a light blocking member to be moved, in conjunction with the development nip operator, to a passing location where the light is passed when the development nip is formed, and a blocking location where the light is blocked when the development nip is released; and a controller to detect whether the development nip is released based on a first surface potential of the photoconductor charged by the charging member in a state in which the development nip is formed, and a second surface potential of the photoconductor after the photoconductor charged by the charging member is exposed to the light by the exposure unit in a state in which the development nip operator is controlled to release the development nip.

2. The image forming apparatus of claim 1, further comprising:

a transfer roller to face the photoconductor and form a transfer nip; and a load measuring unit to measure a load of a transfer system comprising the photoconductor and the transfer roller, wherein the controller is to determine whether the development nip is released, based on a reference load measured by the load measuring unit under the first surface potential, and a detected load measured by the load measuring unit under the second surface potential.

3. The image forming apparatus of claim 2, wherein the controller is to control the exposure unit, before measuring the reference load, to expose the photoconductor to the light.

4. The image forming apparatus of claim 2, wherein the controller, based on a ratio of the reference load and the detected load, is to determine whether the development nip is released.

5. The image forming apparatus of claim 2, wherein the first surface potential is equal to a surface potential of the photoconductor when the electrostatic latent image is formed on the photoconductor.

6. The image forming apparatus of claim 2, wherein an absolute value of the first surface potential is greater than an absolute value of a surface potential of the photoconductor when the electrostatic latent image is formed on the photoconductor.

7. The image forming apparatus of claim 2, wherein the photoconductor comprises a plurality of photoconductors, the developing roller comprises a plurality of developing rollers respectively corresponding to the plurality of photoconductors, the transfer roller comprises a plurality of transfer rollers that respectively face the plurality of photoconductors and form a plurality of transfer systems; and the controller is to control the load measuring unit to measure the reference load and the detected load for each of the plurality of transfer system.

8. The image forming apparatus of claim 7, wherein the controller is to control the development nip operator to move the plurality of developing rollers away from the plurality of photoconductors respectively, and control the load measuring unit, while the plurality of photoconductors are consecutively exposed to the light, to consecutively measure the detected load for each of the plurality of transfer systems.

9. The image forming apparatus of claim 7, wherein the controller is to control the development nip operator to consecutively move the plurality of developing rollers away from the plurality of photoconductors, control the load measuring unit, while the plurality of photoconductors are consecutively exposed to the light, to consecutively measure the detected load for each of the plurality of transfer systems.

10. The image forming apparatus of claim 1, further comprising:

a development cartridge including a photoconductive unit that comprises the photoconductor, and a developing unit that comprises the developing roller and is rotatably connected to the photoconductive unit, wherein the development nip operator is to form and release the development nip by turning the developing unit, and the light blocking member is connected to the developing unit and moved to a position where the light passes and a position where the light is blocked.

11. The image forming apparatus of claim 10, wherein the light blocking member is a part of the developing unit.

12. The image forming apparatus of claim 10, wherein a light path, along which the light passes, is formed between the photoconductive unit and the developing unit, and the light blocking member, when the development nip is released, is to block the light path.

13. A method of detecting release of a development nip in an image forming apparatus comprising a photoconductor and a developing roller to contact each other to form the development nip and to be away from each other to release the development nip, the method comprising:

obtaining a reference load, after charging the photoconductor in a state in which the development nip is formed, by measuring a load of a transfer system comprising the photoconductor and a transfer roller;

releasing the development nip and blocking light irradiated from an exposure unit to the photoconductor;

obtaining a detected load by measuring a load of the transfer system after exposing the photoconductor; and determining whether the development nip is normally released, based on the reference load and the detected load.

14. The method of detecting release of the development nip of claim 13, wherein the photoconductor is exposed before measuring the reference load.

15. The method of detecting release of the development nip of claim 13, further comprising determining whether the development nip is released, based on a ratio of the reference load and the detected load.

16. The method of detecting release of the development nip of claim 13, wherein a surface potential of the photoconductor when measuring the reference load and the detected load is same as a surface potential when an image is formed.

17. The method of detecting release of the development nip of claim 13, wherein an absolute value of a surface potential of the photoconductor when measuring the reference load and the detected load is greater than an absolute value of a surface potential when an image is formed.

18. The method of detecting release of the development nip of claim 13, wherein the image forming apparatus comprises a plurality of developing rollers to form a plurality of development nips with a plurality of photoconductors respectively, and a plurality of transfer rollers to form a plurality of transfer systems with a plurality of the photoconductors respectively, and the method of detecting release of the development nip further comprises measuring the reference load and the detected load for each of the plurality of transfer systems.

19. The method of detecting release of the development nip of claim 18, wherein the detected loads are consecutively measured with respect to each of the plurality of transfer systems while the plurality of development nips are released and the exposure unit consecutively exposes the plurality of photoconductors to the light.

20. The method of detecting release of the development nip of claim 19, wherein the plurality of photoconductors are consecutively exposed and, while the plurality of development nips are consecutively released and a load measuring unit consecutively measures the detected load with respect to each of the plurality of transfer systems.

* * * * *